US010230159B2

(12) United States Patent
Zachara et al.

(10) Patent No.: US 10,230,159 B2
(45) Date of Patent: Mar. 12, 2019

(54) HELICAL ANTENNA FOR WIRELESS MICROPHONE AND METHOD FOR THE SAME

(71) Applicant: Shure Acquisition Holdings, Inc., Niles, IL (US)

(72) Inventors: Christopher Zachara, Lake Bluff, IL (US); Adem Celebi, Oak Park, IL (US); Gregory W. Bachman, Glen Ellyn, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 211 days.

(21) Appl. No.: 14/947,933

(22) Filed: Nov. 20, 2015

(65) Prior Publication Data

US 2017/0149121 A1 May 25, 2017

(51) Int. Cl.
*H04R 1/08* (2006.01)
*H01Q 11/08* (2006.01)
(Continued)

(52) U.S. Cl.
CPC ..... *H01Q 1/27* (2013.01); *H01Q 1/362* (2013.01); *H01Q 5/357* (2015.01); *H01Q 11/08* (2013.01);
(Continued)

(58) Field of Classification Search
CPC ..... H01Q 1/362; H01Q 11/08; H01Q 11/083; H01Q 1/27; H01Q 5/357; H04B 5/06; H04R 1/04; H04R 2420/07; H04R 1/083
See application file for complete search history.

(56) References Cited

U.S. PATENT DOCUMENTS 3,134,075 A * 5/1964 Langevin ..... H04B 5/06 343/901
3,564,416 A * 2/1971 Price ..... H04B 5/06 455/117
(Continued)

FOREIGN PATENT DOCUMENTS

JP 2003037426 2/2003

OTHER PUBLICATIONS

International Search Report and Written Opinion for PCT/US2016/062286 dated Feb. 7, 2017.
(Continued)

*Primary Examiner* — Hoang V Nguyen
*Assistant Examiner* — Awat M Salih
(74) *Attorney, Agent, or Firm* — William J. Lenz; Neal, Gerber & Eisenberg LLP

(57) ABSTRACT

Embodiments include an antenna assembly for a wireless microphone, comprising a helical antenna including a feed point and at least one contact pin coupling the feed point to the wireless microphone. The helical antenna is configured for operation in first and second frequency bands. Embodiments also include a wireless microphone comprising a main body having top and bottom ends and an antenna assembly coupled to the bottom end. The antenna assembly comprises a helical antenna configured to transmit and receive wireless signals, an inner core configured to support the helical antenna on an outer surface of the inner core, and an outer shell formed over the inner core and the helical antenna. Embodiments further include a method of manufacturing an antenna assembly for a wireless microphone using a first manufacturing process to form a core unit of the antenna assembly and a second manufacturing process to form an overmold.

20 Claims, 6 Drawing Sheets

(51) Int. Cl.

| | |
|---|---|
| ***H01Q 1/36*** | (2006.01) |
| ***H01Q 1/27*** | (2006.01) |
| ***H01Q 5/357*** | (2015.01) |
| ***H04R 1/04*** | (2006.01) |

(52) U.S. Cl.
CPC ..... *H04R 1/04* (2013.01); *H04R 1/083* (2013.01); *H04R 2420/07* (2013.01)

(56) References Cited

U.S. PATENT DOCUMENTS 4,344,184 A 8/1982 Edwards
4,725,845 A * 2/1988 Phillips ..... H01Q 1/27 343/702
6,111,554 A * 8/2000 Chufarovsky ..... H01Q 1/244 343/745
6,140,973 A * 10/2000 Annamaa ..... H01Q 1/242 343/725
6,448,934 B1 * 9/2002 Lee ..... H01Q 1/242 343/702
6,611,691 B1 * 8/2003 Zhou ..... H01Q 1/244 343/709
7,301,506 B2 * 11/2007 Kenkel ..... H01Q 1/22 343/700 MS
8,576,131 B2 11/2013 Szopko et al.
2004/0227683 A1 * 11/2004 Caimi ..... H01Q 1/36 343/742
2006/0017649 A1 * 1/2006 Ooi ..... H01Q 1/244 343/895
2009/0202087 A1 8/2009 Nakashima
2011/0211714 A1 9/2011 Plath
2012/0163635 A1 * 6/2012 Szopko ..... H01Q 1/362 381/174
2013/0307735 A1 * 11/2013 Contreras ..... H01Q 1/242 343/702
2014/0011446 A1 * 1/2014 Kangas ..... H04B 5/0031 455/41.1
2014/0177863 A1 * 6/2014 Parkins ..... H04R 1/1091 381/74
2015/0188226 A1 * 7/2015 Ng ..... H01Q 5/00 343/862
2016/0126630 A1 * 5/2016 Martiskainen ..... H01Q 11/12 343/725

OTHER PUBLICATIONS

Celebi, et al., "Bifilar Transverse Bilateral Helical Antenna for Bandwidth Enhancement," IEEE Antennas and Propagation Society International Symposium, Jul. 19-24, 2015.
Noguchi, et al., "A Compact Broad-Band Helical Antenna With Two-Wire Helix," IEEE Transactions on Antennas and Propagation, vol. 51, No. 9, pp. 2176-2181, Sep. 2003.

* cited by examiner

HELICAL ANTENNA FOR WIRELESS MICROPHONE AND METHOD FOR THE SAME

TECHNICAL FIELD

This application generally relates to wireless microphones, and more specifically, to antennas included in wireless microphones.

BACKGROUND

Wireless microphones are used to transmit sound to an amplifier or recording device without need of a physical cable. They are used for many functions, including, for example, enabling broadcasters and other video programming networks to perform electronic news gathering (ENG) activities at locations in the field and the broadcasting of live sports events. Wireless microphones are also used in theaters and music venues, film studios, conventions, corporate events, houses of worship, major sports leagues, and schools.

Typically, wireless microphone systems include a microphone that is, for example, a handheld unit, a body-worn device, or an in-ear monitor; a transmitter (e.g., either built into the handheld microphone or in a separate "body pack" device) comprising one or more antennas; and a remote receiver comprising one or more antennas for communicating with the transmitter. The antennas included in the microphone transmitter and receiver can be designed to operate in certain spectrum band(s), and may be designed to cover either a discrete set of frequencies within the spectrum band or an entire range of frequencies in the band. The spectrum band in which the microphone operates can determine which technical rules and/or government regulations apply to that microphone system. For example, the Federal Communications Commission (FCC) allows the use of wireless microphones on a licensed and unlicensed basis, depending on the spectrum band.

Most wireless microphones that operate today use spectrum within the "Ultra High Frequency" (UHF) bands that are currently designated for television (TV) (e.g., TV channels 2 to 51, except channel 37). Currently, wireless microphone users need a license from the FCC in order to operate in the UHF/TV bands (e.g., 470-698 MHz). However, the amount of spectrum in the TV bands available for wireless microphones is set to decrease once the FCC conducts the Broadcast Television Incentive Auction. This Auction will repurpose a portion of the TV band spectrum—the 600 MHz—for new wireless services, making this band no longer available for wireless microphone use. Wireless microphones can also be designed for operation in the currently licensed "Very High Frequency" (VHF) bands, which cover the 30-300 MHz range.

An increasing number of wireless microphones are being developed for operation in other spectrum bands on an unlicensed basis, including, for example, the 902-928 MHz band, the 1920-1930 MHz band, and the 2.4 GHz band (also known as the "ZigBee" band). However, given the vast difference in frequency between, for example, the UHF/TV bands and the ZigBee band, wireless microphone systems that are specifically designed for one of these two spectrums typically cannot be repurposed for the other spectrum without replacing the existing antenna(s).

Moreover, antenna design considerations can limit the number of antennas that are included within a single device (e.g., due to a lack of available space), while aesthetic design considerations can restrict the type of antennas that can be used. For example, whip antennas are traditionally good performers and by virtue of its external design, take up very little internal device space. However, these antennas can be expensive, distracting (for example, during a performance), and aesthetically unappealing, especially when they are long in length. As another example, handheld microphones typically include a reduced-size antenna that is integrated into the microphone housing to keep the overall package size small and comfortable to use. However, this limitation in antenna size/space makes it difficult for the handheld microphone to provide sufficient radiated efficiency.

More specifically, existing solutions for reduced-sized, broadband antennas include placement of a helical antenna within a housing of the handheld microphone, for example, as shown and described in U.S. Pat. Nos. 7,301,506 and 8,576,131, both of which are incorporated herein by reference in their entirety. In both cases, the helical antenna assembly includes an antenna tape wrapped around a dielectric core to form a single or double helix structure and the pitch, width, and/or length of the antenna tape is adjusted to obtain desired electrical characteristics. However, these existing antenna solutions are ineffective for use in broadband and multiband antenna operations.

Accordingly, there is a need for a wireless microphone system that can adapt to changes in spectrum availability, but still provide consistent, high quality, broadband performance with a low-cost, aesthetically-pleasing design.

SUMMARY

The invention is intended to solve the above-noted problems by providing, among other things, (1) a wireless handheld microphone configured to operate in, for example, currently licensed bands (e.g., UHF/VHF), as well as currently unlicensed spectrum (e.g., 1.8 GHz/2.4 GHz/5.7 GHz), (2) a dual-band helical antenna integrated into a base of the wireless handheld microphone, and (3) a method of manufacturing a helical antenna assembly for the wireless handheld microphone with improved antenna performance.

For example, embodiments include an antenna assembly for a wireless microphone, the antenna assembly comprising a helical antenna including a feed point, and at least one contact pin coupling the feed point to the wireless microphone, wherein the helical antenna is configured for operation in a first frequency band and a second frequency band.

Example embodiments also include a wireless microphone comprising a main body having a top end and a bottom end and an antenna assembly coupled to the bottom end of the main body, wherein the antenna assembly comprises a helical antenna configured to transmit and receive wireless signals, an inner core configured to support the helical antenna on an outer surface of the inner core, and an outer shell formed over the inner core and the helical antenna.

Another example embodiment includes a method of manufacturing an antenna assembly for a wireless microphone, the method comprising forming a core unit with a hollow body and a closed bottom end using a first manufacturing process, coupling a feed end of an antenna element to the core unit, wrapping an antenna element around the core unit to form a helical structure with a free end of the antenna element positioned adjacent to the bottom end of the core unit, and forming an overmold around the antenna element and the core unit using a second manufacturing process.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
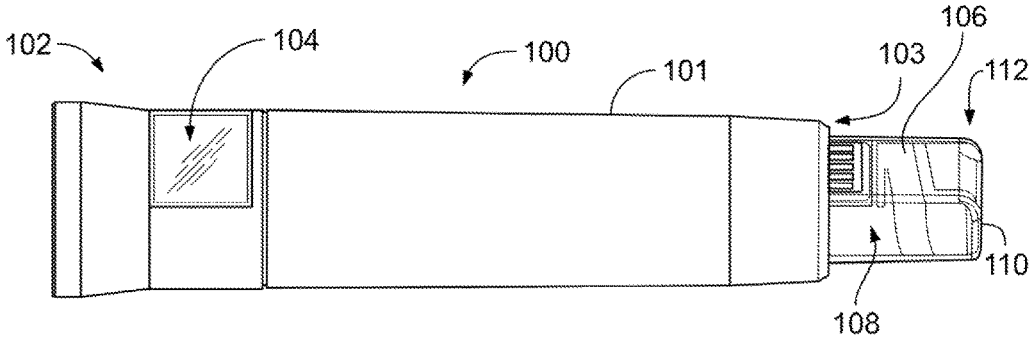
FIG. 1 is a side view of an example handheld wireless microphone, in accordance with certain embodiments.

The description that follows describes, illustrates, and exemplifies one or more particular embodiments of the invention in accordance with its principles. This description is not provided to limit the invention to the embodiments described herein, but rather to explain and teach the principles of the invention in such a way as to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

FIG. 1 illustrates an example handheld wireless microphone 100 in accordance with embodiments. The wireless microphone 100 comprises a main body 101 extending between a top end 102 and an opposing bottom end 103 of the main body 101. The main body 101 may form an elongated, tubular handle for facilitating handheld usage of the microphone 100. The wireless microphone 100 can include a display screen 104 and one or more control buttons and/or switches (not shown) disposed on the main body 101. As will be appreciated, the wireless microphone 100 can also include a microphone head (not shown) coupled to the top end 102. The microphone head typically includes a transducer element for receiving sound input, such as, for example, a dynamic, condenser, ribbon, or any other type of transducer element. The microphone head may also include, for example, a microphone grille, a microphone cover, and/or other components for covering the transducer.

As shown in FIG. 1, the microphone 100 includes at least one antenna 106 and a transmitter, receiver, and/or transceiver (not shown) for supporting wireless applications, including simultaneous transmission and reception of radio frequency (RF) signals between the wireless microphone 100 and other devices within the microphone system (not shown). As illustrated, the antenna 106 (also referred to herein as "helical antenna") can be configured to have a helical or spiral-shaped structure that is wrapped around a core unit 108 (also referred to herein as "inner core"). Further, the core unit 108 and helical antenna 106 combination can be covered by an outer shell 110. In embodiments, the core unit 108 and outer shell 110 may be formed using one or more injection molding techniques, as discussed in more detail below.

The core unit 108, the helical antenna 106, and the outer shell 110 constitute an integrated helical antenna assembly 112 of the wireless microphone 100. As shown in FIG. 1, the helical antenna assembly 112 can be coupled to the bottom end 103 of the main body 101. Placing the helical antenna assembly 112 at the bottom of the main body 101 can help avoid or minimize interference between the antenna 106 and any other electrical components included in the microphone 100. The microphone 100 may further include a bottom cover (not shown) secured to the bottom end 103 for covering and protecting the helical antenna assembly 112.

Figure 2A:
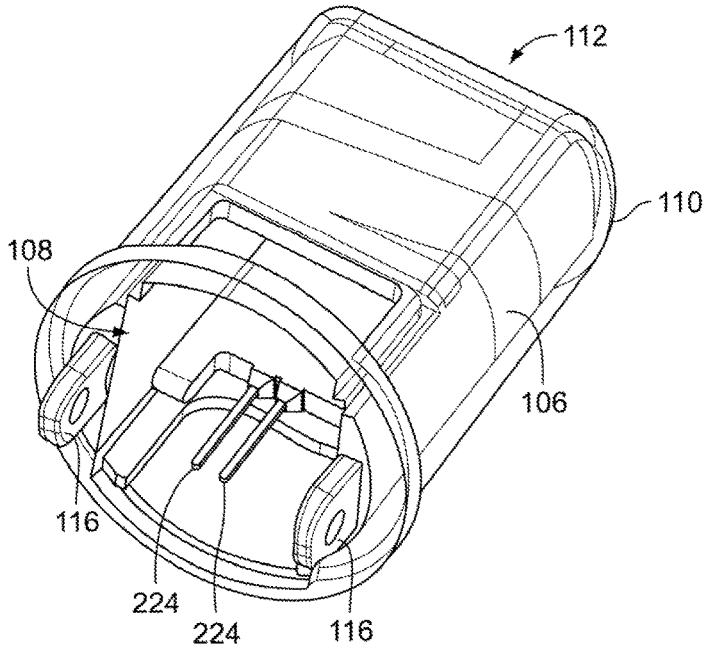
FIG. 2A is a perspective view of an example helical antenna assembly in accordance with certain embodiments.
Figure 2B:
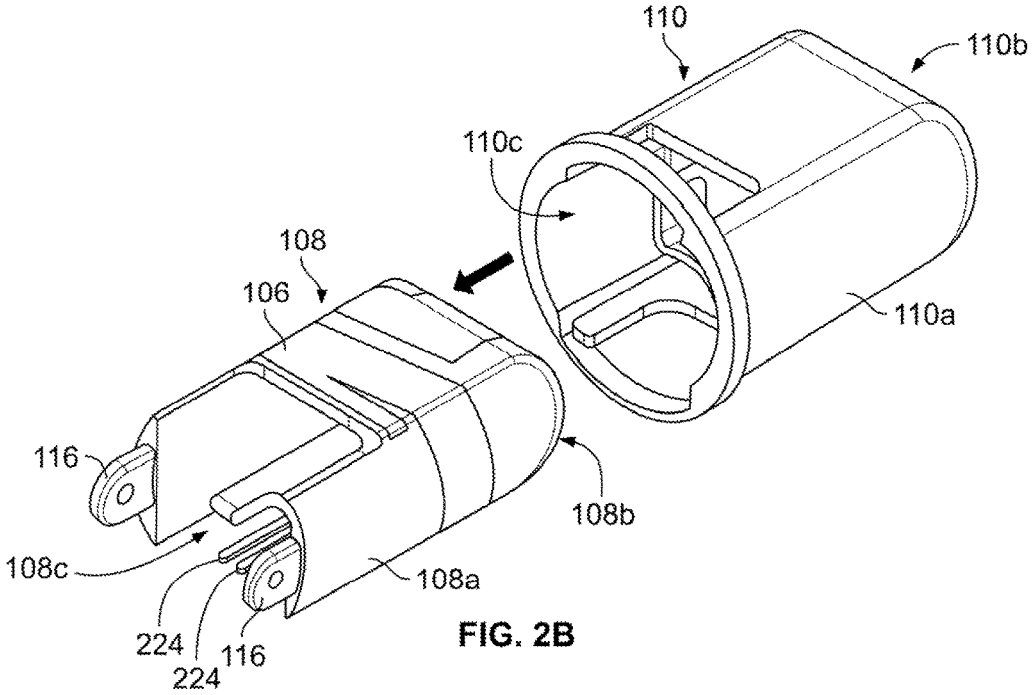
FIG. 2B is an exploded view of the helical antenna assembly shown in FIG. 2A in accordance with certain embodiments.

Referring additionally to FIGS. 2A and 2B, shown is the example helical antenna assembly 112 prior to being coupled to the microphone 100, in accordance with embodiments. In FIG. 2A, the helical antenna assembly 112 is shown fully assembled, while in FIG. 2B, the helical antenna assembly 112 is shown with the outer shell 110 separated from the core unit 108 and antenna 106. For ease of illustration, the outer shell 110 is shown in a transparent form in FIGS. 1 and 2A, and in an opaque form in FIG. 2B.

As will be appreciated, the outer shell 110 can be made of either transparent or opaque material.

Figure 3:
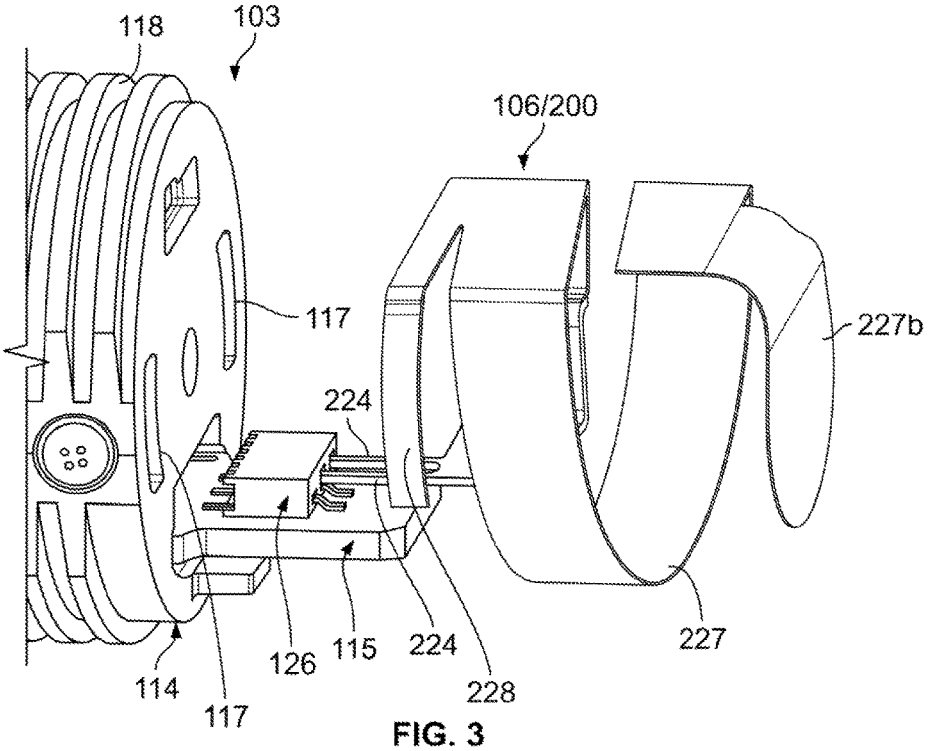
FIG. 3 is a perspective view of a portion of the helical antenna assembly of FIG. 2A, in accordance with certain embodiments.

Referring further to FIG. 3, shown is the example helical antenna 106 coupled to the bottom end 103 of the main body 101, but with the core unit 108, the outer shell 110, and an outer sleeve of the main body 101 removed for ease of illustration. As shown in FIG. 3, the microphone 100 includes a chassis 114 within the main body 101 for supporting various internal components of the microphone 100, including, for example a printed circuit board (PCB) 115. As shown in FIG. 2A, the helical antenna assembly 112 can include one or more tabs 116 for mechanically securing the core unit 108 to the chassis 114, for example, by inserting the tabs 116 into corresponding slits 117 on the chassis 114 shown in FIG. 3. In embodiments, the bottom cover of the microphone 100 can also be coupled to the chassis 114, for example, by securing internal threads (not shown) in the bottom cover to external threads 118 of the chassis 114 shown in FIG. 3.

Figure 4:
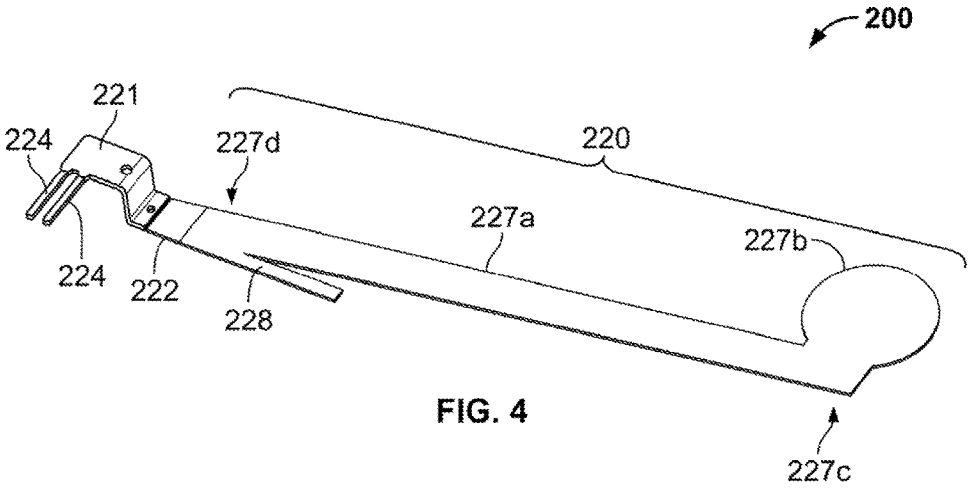
FIG. 4 is a perspective view of an example antenna, in accordance with certain embodiments.

Referring additionally to FIG. 4, shown is an example antenna 200 that can be used to form the helical antenna 106, in accordance with embodiments. As shown, the antenna 200 can comprise an elongated antenna element 220 and a contact plate 221 coupled to a feed point 222 of the antenna element 220. In embodiments, the helical antenna 106 can be formed by wrapping the antenna element 220 around the core unit 108 in a spiral pattern to form a helix. In other embodiments, the antenna element 220 can have a preformed helical shape (e.g., as shown by the helical antenna 200 in FIG. 3) that is attached to the core unit 108, for example, by inserting or sliding the core unit 108 into the antenna 200 structure.

As illustrated, the contact plate 221 includes one or more contact pins 224 that extend out from, and perpendicular to, the antenna element 220. In embodiments, the one or more contact pins 224 are configured to electrically couple the feed point 222 of the antenna element 220 to the PCB 115 within the chassis 114. For example, as shown in FIG. 2, when the antenna 200 is disposed within the helical antenna assembly 112, the one or more pins 224 can extend out from the core unit 108. As shown in FIG. 3, when coupling the helical antenna assembly 112 to the chassis 114, the one or more pins 224 can be inserted into a PCB connector 126 included in the chassis 114 and coupled to the PCB 115. In some cases, the contact plate 221 includes a single pin 224 for electrically coupling the feed point 222 to the PCB 115. In other cases, as shown in FIG. 4, the contact plate 221 includes two pins 224 that effectively, or electrically, operate as a single pin coupled to the PCB connector 126. In such cases, one of the two pins 224 may serve as a redundant electrical connection between the feed point 222 and the PCB 115, for example, in case the other of the two pins 224 fails. According to embodiments, the one or more pins 224 and/or the contact plate 221 can be made of metal and/or coated with a metal plating to ensure good conductivity between the antenna element 220 and the PCB connector 126.

According to embodiments, the antenna element 220 can be frequency-scalable in order to cover any desired operating band and can include multiple antenna structures coupled to a common feed location, or the feed point 222, in order to cover a plurality of different frequency bands. For example, the antenna element 220 can operate as a dual-band antenna that includes a first antenna structure 227 that is configured for wireless operation in a first frequency band and a second antenna structure 228 that is configured for wireless operation in a second frequency band. In embodiments, the first frequency band can include any of the UHF bands (e.g., 470-950 MHz), any of the VHF bands (e.g., 30-300 MHz), or any combination thereof, and the second frequency band can include the 902-928 MHz band, the 1920-1930 MHz band, the 1.8 GHz band, the 2.4 GHz band, the 5.7 GHz band, or any combination thereof. In a preferred embodiment, the first frequency band includes a lower UHF band (e.g., 470-636 MHz), and the second frequency band includes the Zigbee 2.4 GHz band.

A length, width, angle, and configuration of the antenna structures 227, 228 can be selected in order to optimize antenna performance in the given frequency band(s) and provide a broadband antenna 200. For example, due to the inverse relationship between antenna length and frequency coverage, the first antenna structure 227, which covers lower operating bands, may be significantly longer than the second antenna structure 228, which covers higher operating bands. As shown in FIG. 4, the second antenna structure 228 includes a small strip, or tab, that extends from the feed point 222 at a predetermined angle relative to the first antenna structure 227. As also shown in FIG. 4, the first antenna structure 227 includes an elongated portion 227*a* (also referred to herein as "elongated body"), a rounded tab portion 227*b* (also referred to herein as "rounded end") at an open end 227*c* of the first antenna structure 227, and an opposing, fixed end 227*d* coupled to the feed point 222. The rounded tab portion 227*b* extends perpendicularly to the elongated portion 227*a* and serves to further increase an antenna length, and bandwidth, of the first antenna structure 227, thereby improving the performance of the antenna 200 at lower operating bands.

To keep an overall size of the antenna 200 at a minimum, the antenna element 220 can be configured to conform to the shape of the core unit 108 and cover a surface area of the core unit 108. For example, as shown in FIG. 3, the elongated portion 227*a* of the first antenna structure 227 can be swept or twisted into a spiral configuration that conforms to an elongated body 108*a* of the core unit 108 (see also, FIG. 6B), and the rounded tab portion 227*b* can be folded down over a bottom end 108*b* of the core unit 108 and sized to cover a substantial portion of the bottom end 108*b*. Likewise, the second antenna structure 228 can be also bent or molded to fit around the core unit 108, as shown in FIGS. 3 and 6C. The angle at which the second antenna structure 228 extends from the feed point 222 relative to the first antenna structure 227 can be selected so that sufficient spacing is maintained between the two antenna structures 227, 228.

As will be appreciated, other antenna structures, shapes, sizes, lengths, and/or configurations may be utilized to form the antenna 200 depending on a desired frequency coverage and/or antenna performance standard, as well as the size, shape, and/or configuration of the core unit 108. For example, in some embodiments, the tab portion 227*b* may have a rectangular, square, polygonal, oval, or any other shape that can fit onto the bottom end 108*b* of the core unit 108. As another example, the second antenna structure 228 may have any other shape, including, for example, a rounded or triangular shape, so long as the structure 228 does not interfere with the first antenna structure 227. Further, while FIGS. 4 and 6C show the second antenna structure 228 as have a tab-like configuration that extends away from the first antenna structure 227 at a predetermined angle, other configurations for the second antenna structure 228 may be utilized.

Figure 8:
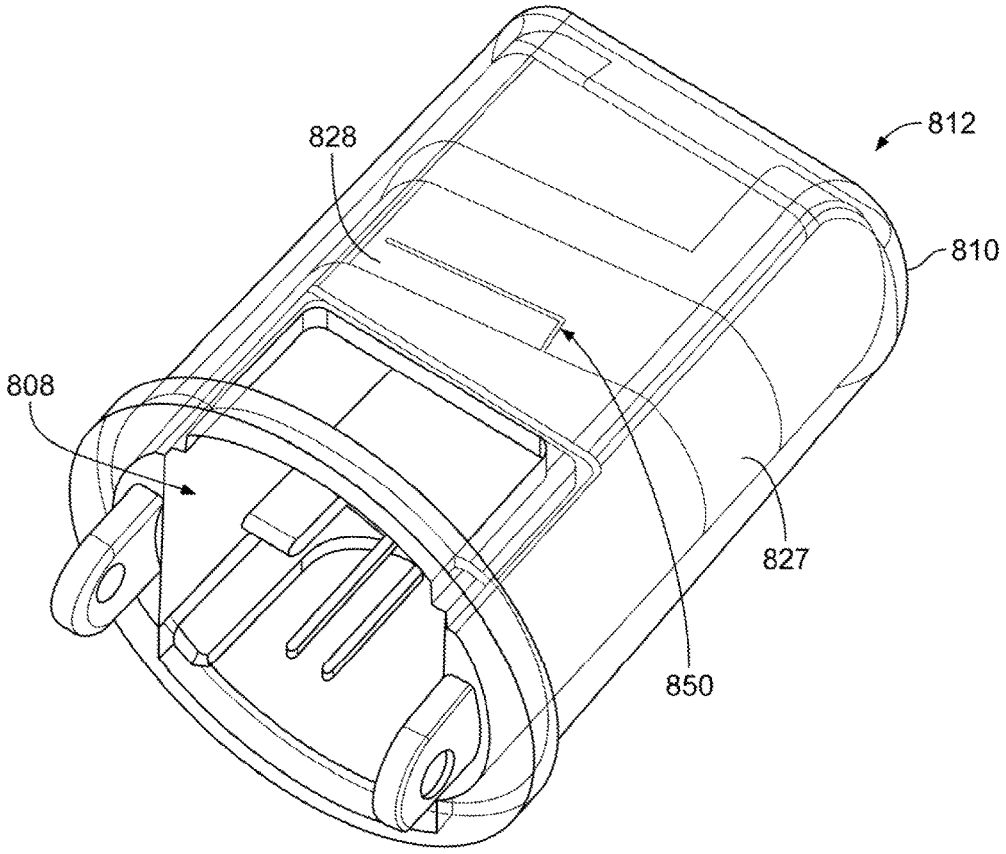
FIG. 8 is a perspective view of a portion of an example helical antenna assembly, in accordance with certain embodiments.

For example, FIG. 8 depicts another exemplary helical antenna assembly 812 comprising a core unit 808 (e.g., similar to the core unit 108 described herein), a first antenna structure 827 and a second antenna structure 828 wrapped around the core unit 808, and an outer shell or overmold 810 that covers the antenna structures 827, 828 and the core unit 808 (e.g., similar to the outer shell 110 described herein). As shown, the second antenna structure 828 runs parallel to the first antenna structure 827 along a surface of the core unit 808, rather than extending out at an angle, as shown in FIG. 6C. Further, the first antenna structure 827 is spatially and electrically separated from the second antenna structure 828 by an L-shaped slot 850. The exact dimensions, shape, and configuration of the slot 850 can be selected as need to optimize performance of the second antenna structure 828, and/or to obtain a desired size, or frequency band, for the first antenna structure 827 and/or the second antenna structure 828.

Figure 5:
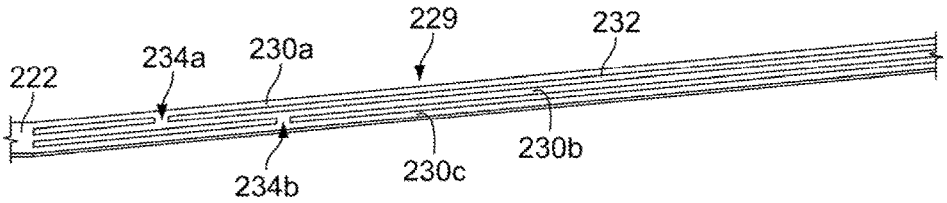
FIG. 5 is a close up view of an antenna tape, in accordance with certain embodiments.

Referring now to FIG. 5, shown is a close up view of an example antenna tape 229 (also referred to as an "antenna wrap") that may be used to construct all or portions of the antenna element 220, in accordance with embodiments. For example, at least one of the first antenna structure 227 and the second antenna structure 228 may be formed using the antenna tape 229. As shown, the antenna tape or wrap 229 includes a plurality of flat, conductive strips 230 placed lengthwise on a substrate portion 232 and positioned in parallel to each other and the substrate portion 232. According to embodiments, the antenna tape 229 can have an adhesive backing (not shown) to facilitate adhering the antenna element 220 to the core unit 108. Also in embodiments, the conductive strips 230 can be made of copper foil (also referred to as "copper ribbons") or any other suitable conductive material, and the substrate portion 232 can be made of polyester or any other suitable non-conductive material.

In embodiments, the antenna tape 229 can include two or more conductive strips 230 that are interconnected to neighboring strips 230 through the placement of one or more shorting pins 234 at predetermined locations on the substrate portion 232. The predetermined locations of the shorting pins 234 can be selected to provide optimal impedance matching for the antenna 200. For example, the shorting pins 234 can be positioned to provide an input impedance of about 50 ohms, so that the antenna 200 can be impedance matched to a 50 ohm reference impedance (e.g., transmission line) without the use of a lump component matching network. The use of multiple antenna strips 230 and multiple shorting pins 234 also enables multiple antenna modes to be excited at different frequencies, thereby resulting in a wider operational bandwidth and improved radiated efficiency for the antenna 200. Moreover, a length, width, and pitch value for each conductive strip 230 can be selected to optimize antenna performance and provide coverage of desired frequency band(s).

In FIG. 5, the conductive strips 230 are positioned in parallel to each other to form a "step-up configuration" (e.g., similar to a step-up transformer) that increases an overall input impendence of the antenna tape 229. In other embodiments, the conductive strips 230 can be placed at a certain angle relative to each other, so that the distance between neighboring strips 230 increases or decreases along the antenna tape 229 (e.g., from the feed point 222 to the open end 227*c*). In such cases, a more complex step-up relationship may be formed between the conductive strips 230 to provide the intended antenna operation and impedance characteristic.

In the illustrated embodiment, the antenna tape 229 includes three conductive strips 230*a*, 230*b*, and 230*c*, with a first shorting pin 234*a* positioned between top strip 230*a* and middle strip 230*b*, and a second shorting pin 234*b* positioned between the middle strip 230*b* and bottom strip 230*c*. Other configurations and combinations for the conductive strips 230 and the shorting pins 234 are also contemplated, including a fewer or greater number of strips 230 and a fewer or greater number of pins 234, in accordance with the principles and techniques disclosed herein. For example, in one embodiment (not shown), the antenna tape 229 may include two conductive strips 230 with one shorting pin 234 positioned between the two strips 230.

Figure 6A:
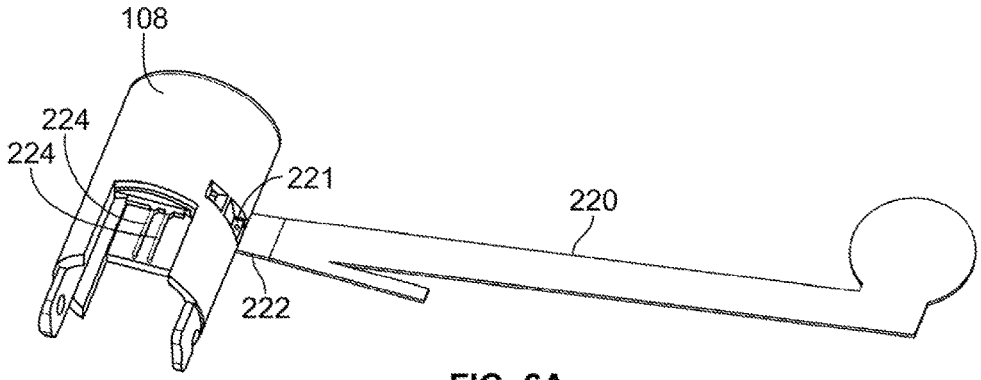
FIG. 6A is a perspective view of a portion of the helical antenna assembly of FIG. 2 during one manufacturing stage, in accordance with certain embodiments.
Figure 6B:
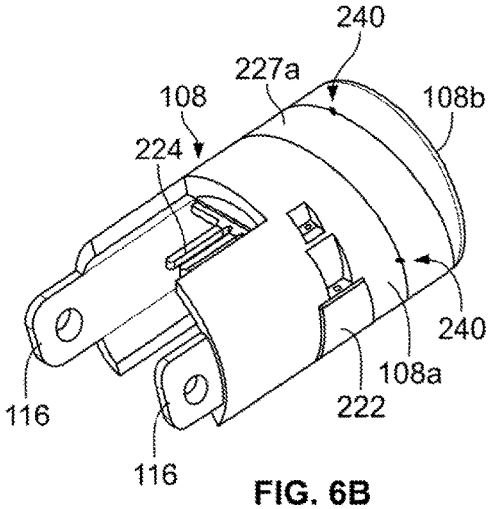
FIG. 6B is a front perspective view of the portion shown in FIG. 6A during another manufacturing stage, in accordance with certain embodiments.
Figure 6C:
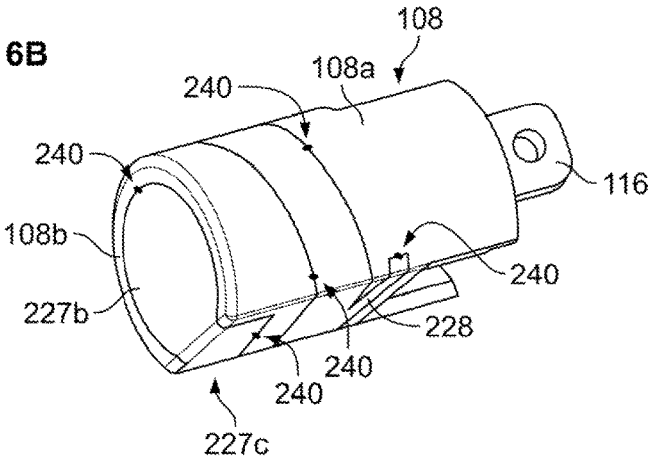
FIG. 6C is a back perspective view of the portion shown in FIG. 6B during another manufacturing stage, in accordance with certain embodiments.

Referring now to FIGS. 6A-6C, shown are views of the helical antenna assembly 112 during different stages of assembly, in accordance with embodiments. Specifically, FIG. 6A may represent a first stage of assembly in which the antenna 200 is coupled to the core unit 108 by inserting the contact plate 221 into the core unit 108 and extending the pins 224 through corresponding apertures in the core unit 108. FIG. 6B may represent a second stage of assembly in which the antenna element 220 is wrapped around the elongated body 108*a* of the core unit 108 in a helical pattern and affixed thereto. FIG. 6C may represent a third stage of assembly in which the rounded tab portion 227*b* of the first antenna structure 227 is folded down onto the bottom end 108*b* of the core unit 108 and affixed thereto.

Figure 7:
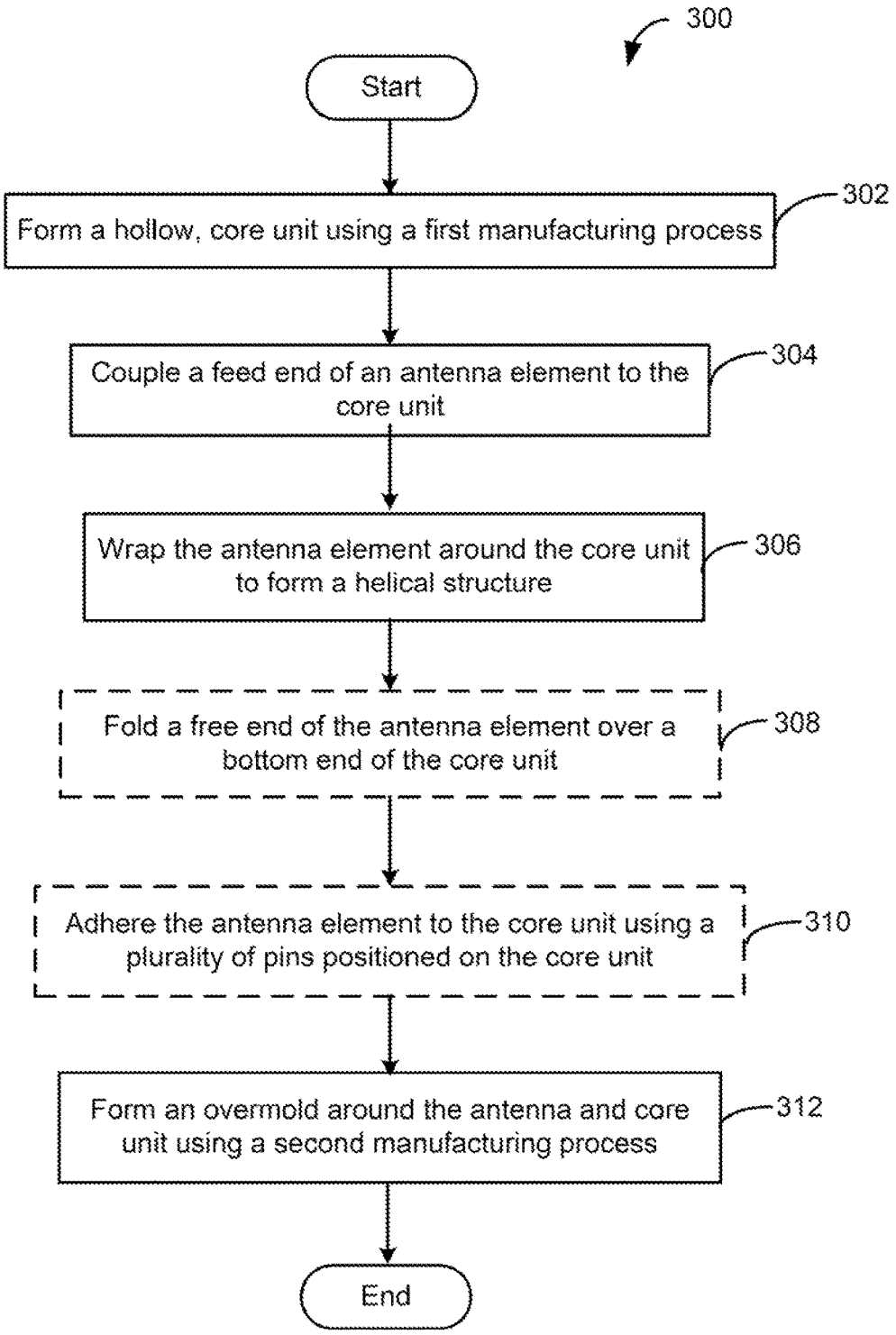
FIG. 7 is a flow diagram illustrating an example process for manufacturing a helical antenna assembly, in accordance with certain embodiments.

Referring additionally to FIG. 7, shown is a flow diagram of an example method 300 for manufacturing an integrated helical antenna assembly, such as, for example, the helical antenna assembly 112 shown in FIG. 2, in accordance with embodiments. The method 300 describes a multi-step manufacturing and assembly process for creating the integrated helical antenna assembly. For ease of explanation, the method 300 will be described with reference to FIGS. 6A-6C and the helical antenna assembly 112 shown in FIGS. 2A and 2B. However, it will be appreciated that the method 300 may be utilized to construct other helical antenna assemblies, such as, for example, the helical antenna assembly 812 shown in FIG. 8, in accordance with the principles and techniques disclosed herein.

As shown, the method 300 can begin at step 302 by forming a hollow core unit, such as, for example, the core unit 108, using a first manufacturing process. For example, the core unit 108 can be formed during a first step of a multi-step injection molding process, such as, e.g., an inner core molding step. In embodiments, the core unit 108 is manufactured from a low-loss dielectric material, such as, for example, Thermoplastic Vulcanizate (TPV), Thermoplastic Urethane (TPU), or other suitable material. The mold used to construct the core unit 108 can be configured to minimize the dielectric loss in the helical antenna assembly 112, thereby improving the antenna efficiency and bandwidth of the antenna 200. For example, in embodiments, the core unit 108 may be designed to have a minimal amount of dielectric material by forming the core unit 108 as a generally tubular shell with a hollow center and an open top end 108*c* opposite the closed bottom end 108*b*. The walls of the core unit 108 can be configured to have a minimal thickness based on a minimum thickness required to maintain the structural integrity of the walls, and a minimum amount of dielectric material needed to tune the antenna 200. By reducing the total amount of dielectric material included in the core unit 108, the core unit 108 exhibits less dielectric loss, which translates into better radiation efficiency (e.g., as compared to a solid core unit made from the same dielectric material). The air inside the hollow core unit 108 improves radiated efficiency of the first and second antenna structures.

Accordingly, the core unit 108 of the helical antenna assembly 112 can exhibit improved antenna efficiency without being dielectrically loaded.

At step 304, the method 300 includes coupling a feed end of an antenna, such as, for example, the feed point 222 of the antenna 200, to the core unit. As shown in FIG. 6A, step 304 may include inserting the contact plate 221 and the contact pins 224 of the antenna 200 into corresponding apertures of the core unit 108 and ensuring that the contact pins 224 extend out of the core unit 108 and towards the top end 108*c*.

At step 306, the method 300 includes wrapping an antenna element of the antenna, such as, for example, the antenna element 220, around the core unit to form a helical structure, for example, as shown in FIG. 6B. In embodiments where the antenna element 220 includes the first and second antenna structures 227, 228 to accommodate different operating bands, for example, as shown in FIG. 4, the method 300 further includes step 308, where a free end of the antenna element, such as, for example, the rounded tab portion 227*b* of the first antenna structure 227, is folded down over the bottom end 108*b* of the core unit 108, for example, as shown in FIG. 6C. As discussed above, the antenna element 220 may include an adhesive backing for affixing the antenna element 220 to the core unit 108 once the antenna element 220 is positioned thereon.

In some embodiments, the method 300 further includes, at step 310, adhering the antenna element to an outer surface of the core unit using a plurality of pins positioned on the core unit. For example, as shown in FIGS. 6B and 6C, one or more pins 240 may be disposed throughout a top surface of the core unit 108. In embodiments, the pins 240 may be configured to hold the antenna 200 in place and retain its shape during one or more manufacturing processes, such as, e.g., the multi-step injection molding process. As will be appreciated, during an injection molding process, the antenna 200 may be subject to a high amount of pressure and/or temperature variations that may cause deformation or other alteration of the antenna element 220. In some cases, the exact placement of the pins 240 may vary depending on a shape, size, and/or configuration of the antenna structures 227 and 228. In other cases, the pins 240 may be installed in locations that are pre-selected to be appropriate for any type of antenna structure included in the antenna element 220.

At step 312, the method 300 includes forming an outer shell or overmold, such as, for example, the outer shell 110, around the antenna and core unit using a second manufacturing process. For example, the outer shell 110 can be formed during a second step of the multi-step injection molding process, such as, e.g., an over-shot molding step. In other cases, the outer shell 110 may be separately or independently formed and then coupled to the antenna and core unit using, for example, an adhesive or other form of attachment. As shown in FIG. 2B, the outer shell 110 includes a generally tubular body 110*a* that extends between a closed bottom end 110*b* and an open opposing end 110*c*. In embodiments, the tubular body 110*a* has a hollow center that is configured to house, or fit over, the core unit 108 as an overmold and protect the antenna and the core unit from damage or deformation caused by, for example, impact, corrosion, or oxidation. The outer shell 110 can have a minimal thickness for improved antenna aperture, bandwidth, and efficiency, and reduced dielectric loss, similar to the core unit 108. An external surface of the outer shell 110 can include cosmetic elements to match an outer surface of the microphone body 101 or otherwise visually conform to the rest of the microphone 100. Also according to embodiments, the outer shell 110 of the helical antenna assembly 112 can be formed from Thermoplastic Vulcanizate (TPV), Thermoplastic Urethane (TPU), or any other suitable dielectric material.

Thus, a dual-band helical antenna assembly with greatly improved bandwidth and high radiated efficiency is provided, in accordance with the principles and techniques described herein. In embodiments, the helical antenna assembly includes a three-dimensional, conformal, multi-strip, helical antenna structure for providing the high radiated efficiency, which also renders the helical antenna assembly less susceptible to detuning caused by human loading. Moreover, the antenna includes two distinct antenna structures for operating effectively over at least two distinct frequency bands (e.g., the UHF bands and the 2.4 GHz band). The two antenna structures are coupled to one feed point and can provide simultaneous transmission and reception in the covered frequency bands. In addition, due at least in part to the structural design of the antennas included therein, the helical antenna assembly can provide 50 ohm input impedance without the use of a lump component matching network. Also, the helical antenna structure is disposed in an integrated antenna assembly that is manufactured using a multi-step molding process configured to minimize material dielectric losses in the antenna. For example, the multi-step molding process includes creating a hollow core shell for supporting the helical antenna using a minimal amount of dielectric material and creating a dielectric overmold for placement over the core and antenna combination.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An antenna assembly for a wireless microphone, comprising:

a helical antenna including a feed point, a first antenna structure sized and shaped for optimal operation in a first frequency band, and a second antenna structure sized and shaped for optimal operation in a second frequency band that does not overlap with the first frequency band; and at least one contact pin coupling the feed point to the wireless microphone, wherein each of the first antenna structure and the second antenna structure includes a fixed end and an opposing free end, the fixed ends being joined together adjacent to the feed point, and the free ends radiating out independently from the feed point such that the free end of the first antenna structure is spatially separated from the free end of the second antenna structure.

2. The antenna assembly of claim 1, wherein the first antenna structure is longer in length than the second antenna structure.

3. The antenna assembly of claim 1, wherein the second frequency band includes at least 2.4 Gigahertz (GHz) operating band.

4. The antenna assembly of claim 1, wherein the first frequency band includes at least one Ultra High Frequency (UHF) operating band.

5. The antenna assembly of claim 1, wherein the helical antenna is configured to simultaneously transmit and receive wireless signals in the first and second frequency bands.

6. The antenna assembly of claim 1, further comprising a core unit, wherein the helical antenna includes two or more conductive strips wound around the core unit in a parallel arrangement.

7. The antenna assembly of claim 1, wherein the at least one contact pin includes a primary contact pin and a redundant contact pin.

8. A wireless microphone, comprising:

a main body having a top end and a bottom end; and an integrated, one-piece antenna assembly coupled to the bottom end of the main body, the antenna assembly comprising:

a helical antenna configured to transmit and receive wireless signals;

an inner core supporting the helical antenna on an outer surface of the inner core; and an outer shell formed around the inner core and the helical antenna using an overmolding process, such that the outer shell is fixedly coupled to the inner core and the helical antenna, wherein the helical antenna includes a feed point, a first antenna structure, and a second antenna structure, each structure comprising a fixed end and an opposing free end, the fixed ends being joined together adjacent to the feed point, and the free ends radiating out independently from the feed point to form a spatially separated arrangement.

9. The wireless microphone of claim 8, wherein the helical antenna is wrapped around the inner core to form a helix configuration.

10. The wireless microphone of claim 9, wherein the inner core comprises a hollow body and a closed bottom end.

11. The wireless microphone of claim 10, wherein the first antenna structure has an elongated body wrapped around the hollow body and a rounded end portion folded over the closed bottom end.

12. The wireless microphone of claim 11, wherein the second antenna structure is shorter in length than the first antenna structure.

13. The wireless microphone of claim 8, wherein the inner core is mechanically coupled to the bottom end of the main body.

14. The wireless microphone of claim 8, wherein the antenna assembly further comprises a plurality of pins for securing the helical antenna to the outer surface of the inner core.

15. The wireless microphone of claim 8, wherein the inner core and the outer shell are formed using a multi-step injection molding process.

16. A method of manufacturing an antenna assembly for a wireless microphone, the method comprising:

creating a core unit with a hollow body and a closed bottom end using a first manufacturing process;

coupling a feed end of an antenna element to the core unit, wherein the antenna element includes a first antenna structure and a second antenna structure, each structure comprising a fixed end and an opposing free end, the fixed ends being joined together adjacent to the feed end of the antenna element, and the free ends radiating out independently from the feed end to form a spatially separated arrangement;

wrapping the antenna element around the core unit to form a helical structure with the free end of the first antenna structure positioned adjacent to the bottom end of the core unit; and creating an overmold around the antenna element and the core unit using a second manufacturing process, such that the overmold is fixedly coupled to the core unit and antenna element.

17. The method of claim 16, further comprising adhering the antenna element to the core unit using a plurality of pins positioned on an outer surface of the core unit.

18. The method of claim 16, further comprising folding the free end of the first antenna structure over the bottom end of the core unit.

19. The method of claim 16, wherein the first antenna structure comprises an elongated body extending from the feed end to the free end, and the second antenna structure has a length that is shorter than that of the first antenna structure.

20. The method of claim 16, wherein the first manufacturing process and the second manufacturing process are consecutive steps of a multi-step injection molding process.

* * * * *